US009747909B2

(12) United States Patent
Breebaart et al.

(10) Patent No.: US 9,747,909 B2
(45) Date of Patent: Aug. 29, 2017

(54) SYSTEM AND METHOD FOR REDUCING TEMPORAL ARTIFACTS FOR TRANSIENT SIGNALS IN A DECORRELATOR CIRCUIT

(71) Applicants: DOLBY LABORATORIES LICENSING CORPORATION, San Francisco, CA (US); DOLBY INTERNATIONAL AB, Amsterdam Zuidoost (NL)

(72) Inventors: Dirk Jeroen Breebaart, Pyrmont (AU); Lie Lu, Beijing (CN); Antonio Mateos Sole, Barcelona (ES); Nicolas R. Tsingos, Palo Alto, CA (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 14/907,542

(22) PCT Filed: Jul. 23, 2014

(86) PCT No.: PCT/US2014/047891

§ 371 (c)(1),
(2) Date: Jan. 25, 2016

(87) PCT Pub. No.: WO2015/017223

PCT Pub. Date: Feb. 5, 2015

(65) Prior Publication Data

US 2016/0180858 A1 Jun. 23, 2016

Related U.S. Application Data

(60) Provisional application No. 61/884,672, filed on Sep. 30, 2013.

(30) Foreign Application Priority Data

Jul. 29, 2013 (ES) ..... 201331160

(51) Int. Cl.
*G10L 19/00* (2013.01)
*G10L 19/02* (2013.01)
(Continued)

(52) U.S. Cl.
CPC ..... *G10L 19/025* (2013.01); *G10L 19/008* (2013.01); *G10L 19/06* (2013.01);
(Continued)

(58) Field of Classification Search
CPC ..... G10L 19/025; G10L 19/02; G10L 19/00
See application file for complete search history.

(56) References Cited

U.S. PATENT DOCUMENTS 6,424,939 B1 * 7/2002 Herre ..... H04B 1/665 704/219
7,983,424 B2 7/2011 Kjorling
(Continued)

FOREIGN PATENT DOCUMENTS

RS 1332 U 8/2013
WO 2005/101370 10/2005
(Continued)

OTHER PUBLICATIONS

Stanojevic, Tomislav "3-D Sound in Future HDTV Projection Systems," 132nd SMPTE Technical Conference, Jacob K. Javits Convention Center, New York City, New York, Oct. 13-17, 1990, 20 pages.

(Continued)

*Primary Examiner* — Samuel G Neway

(57) ABSTRACT

Embodiments are directed to a method for processing an input audio signal, comprising: splitting the input audio
(Continued)

signal into at least two components, in which the first component is characterized by fast fluctuations in the input signal envelope, and a second component that is relatively stationary over time; processing the second, stationary component by a decorrelation circuit; and constructing an output signal by combining the output of the decorrelator circuit with the input signal and/or the first component signal.

25 Claims, 6 Drawing Sheets

(51) Int. Cl.
*G10L 19/025* (2013.01)
*G10L 19/008* (2013.01)
*G10L 19/06* (2013.01)
*G10L 19/26* (2013.01)

(52) U.S. Cl.
CPC ..... *G10L 19/26* (2013.01); *G10L 19/00* (2013.01); *G10L 19/02* (2013.01)

(56) References Cited

U.S. PATENT DOCUMENTS

| | | | | |
|---|---|---|---|---|
| 8,063,809 | B2 | 11/2011 | Liu | |
| 8,145,499 | B2 | 3/2012 | Herre | |
| 2003/0115052 | A1 | 6/2003 | Chen | |
| 2004/0044533 | A1* | 3/2004 | Najaf-Zadeh | G10L 19/032 704/500 |
| 2009/0326959 | A1* | 12/2009 | Herre | H04S 5/00 704/500 |
| 2010/0030563 | A1* | 2/2010 | Uhle | G10L 19/008 704/500 |
| 2011/0112670 | A1* | 5/2011 | Disch | G10L 21/04 700/94 |
| 2011/0200196 | A1* | 8/2011 | Disch | H04S 7/30 381/22 |
| 2011/0202358 | A1* | 8/2011 | Neuendorf | G10L 19/0208 704/503 |
| 2011/0251846 | A1* | 10/2011 | Liu | G10L 19/025 704/500 |
| 2012/0010879 | A1* | 1/2012 | Tsujino | G10L 19/06 704/203 |
| 2013/0173273 | A1* | 7/2013 | Kuntz | G10L 19/008 704/500 |
| 2013/0304480 | A1* | 11/2013 | Kuntz | G10L 19/00 704/500 |
| 2015/0170663 | A1* | 6/2015 | Disch | G10L 21/038 704/500 |
| 2016/0180858 | A1* | 6/2016 | Breebaart | G10L 19/008 704/504 |

FOREIGN PATENT DOCUMENTS

| | | |
|---|---|---|
| WO | 2006/045373 | 5/2006 |
| WO | 2010/019192 | 2/2010 |
| WO | 2010/086194 | 8/2010 |
| WO | 2012/025282 | 3/2012 |
| WO | 2012/025283 | 3/2012 |

OTHER PUBLICATIONS

Stanojevic, Tomislav "Surround Sound for a New Generation of Theaters," Sound and Video Contractor, Dec. 20, 1995, 7 pages.
Stanojevic, Tomislav "Virtual Sound Sources in the Total Surround Sound System," SMPTE Conf. Proc.,1995, pp. 405-421.
Stanojevic, Tomislav et al. "Designing of TSS Halls," 13th International Congress on Acoustics, Yugoslavia, 1989, pp. 326-331.
Stanojevic, Tomislav et al. "Some Technical Possibilities of Using the Total Surround Sound Concept in the Motion Picture Technology," 133rd SMPTE Technical Conference and Equipment Exhibit, Los Angeles Convention Center, Los Angeles, California, Oct. 26-29, 1991, 3 pages.
Stanojevic, Tomislav et al. "The Total Surround Sound (TSS) Processor," SMPTE Journal, Nov. 1994, pp. 734-740.
Stanojevic, Tomislav et al. "The Total Surround Sound System (TSS System)", 86th AES Convention, Hamburg, Germany, Mar. 7-10, 1989, 21 pages.
Stanojevic, Tomislav et al. "TSS Processor" 135th SMPTE Technical Conference, Los Angeles Convention Center, Los Angeles, California, Society of Motion Picture and Television Engineers, Oct. 29-Nov. 2, 1993, 22 pages.
Stanojevic, Tomislav et al. "TSS System and Live Performance Sound" 88th AES Convention, Montreux, Switzerland, Mar. 13-16, 1990, 27 pages.
Kuntz, A. et al "The Transient Steering Decorrelator Tool in the Upcoming MPEG Unified Speech and Audio Coding Standard" AES Convention Paper 8533, presented at the 131st Convention, Oct. 20-23, 2011, New York, USA, pp. 1-9.
Blauert, Jens "Spatial Hearing Revised Edition: The Psychophysics of Human Sound Localization" MIT Press, 1996.
Breebaart, J. et al "Spatial Audio Processing: MPEG Surround and other Applications", John Wiley & Sons, Chichester, UK, Dec. 2007, 224 pages.
Breebaart, J. et al "MPEG Surround Standard on Multi-channel Audio Compression" J. Audio Engineering Society 55, pp. 331-351, 2007.
Breebaart, J. et al "Parametric Coding of Stereo Audio" EURASIP Journal on Advances in Signal Processing vol. 2005, No. 9, Jan. 1, 2005, pp. 1305-1322.
ISO/IEC 232003-1:2007, Information Technology—MPEG Audio Technologies, MPEG Surround.
Herre, J. et al "MPEG Surround—The ISO/MPEG Standard for Efficient and Compatible Multichannel Audio Coding" J. Audio Eng. Soc., vol. 56, No. 11, Nov. 2008, pp. 932-955.

* cited by examiner

SYSTEM AND METHOD FOR REDUCING TEMPORAL ARTIFACTS FOR TRANSIENT SIGNALS IN A DECORRELATOR CIRCUIT

CROSS REFERENCE TO RELATED APPLICATIONS

This application claims priority to Spanish Patent Application No. P201331160, filed on 29 Jul. 2013 and U.S. Provisional Patent Application No. 61/884,672, filed on 30 Sep. 2013, each of which is hereby incorporated by reference in its entirety.

TECHNICAL FIELD

One or more embodiments relate generally to audio signal processing, and more specifically to decorrelating audio signals in a manner that reduces temporal distortion for transient signals, and which can be used to modify the perceived size of audio objects in an object-based audio processing system.

BACKGROUND

Sound sources or sound objects have spatial attributes that include their perceived position, and a perceived size or width. In general, the perceived width of an object is closely related to the mathematical concept of inter-aural correlation or coherence of the two signals arriving at our eardrums. Decorrelation is generally used to make an audio signal sound more spatially diffuse. The modification or manipulation of the correlation of audio signals is therefore commonly found in audio processing, coding, and rendering applications. Manipulation of the correlation or coherence of audio signals is typically performed by using one or more decorrelator circuits, which take an input signal and produce one or more output signals. Depending on the topology of the decorrelator, the output is decorrelated from its input, or outputs are mutually decorrelated from each other. The correlation measure of two signals can be determined by calculating the cross-correlation function of the two signals. In general, the correlation measure is the value of the peak of the cross-correlation function (often referred to as coherence) or the value at lag (relative delay) zero (the correlation coefficient). Decorrelation is defined as having a normalized cross-correlation coefficient or coherence smaller than +1 when computed over a certain time interval of duration T:

$$\rho = \frac{\int_0^T x(t)y(t)dt}{\sqrt{\int_0^T x^2(t)dt \int_0^T y^2(t)dt}}$$

$$\Phi = \max \frac{\int_0^T x(t+\tau/2)y(t-\tau/2)\,dt}{\sqrt{\int_0^T x^2(t+\tau/2)dt \int_0^T y^2(t-\tau/2)dt}}$$

In the above equations, x(t), y(t) are the signals subject to having a mutually low correlation, p is the normalized cross-correlation coefficient, and the coherence. The coherence value is equivalent to the maximum of the normalized cross-correlation function across relative delays $\tau$.

In spatial audio processing, signal decorrelation can have a significant impact on the perception of sound imagery, and the correlation of measure is a significant predictor of perceptual effects in audio reproduction. FIG. 1 illustrates two configurations of a simple decorrelator, as known in the prior art. The upper circuit 100 decorrelates the output signal y(t) from the input signal x(t), while the lower circuit 101 produces two mutually decorrelated outputs y(t) and x(t), which may or may not be decorrelated from the common input. A wide variety of decorrelation processes have been proposed for use in current systems, varying from simple delays, frequency-dependent delays, random-phase all-pass filters, lattice all-pass filters, and combinations thereof. These processes all significantly modify their input signals, such as by changing their waveforms. For stationary or smoothly continuous signals, such modification is generally not problematic. However, for impulsive or fast-changing signals (transients), such modification may result in unwanted distortion. For example, with regard to the onset of a transient signal, modifying the waveform by decorrelation can cause temporal smearing or similar effects. Likewise, upon cessation of the transient signal, decorrelation may result in post- echo or reverberation-like effects that are audible when the input signal has a steep decrease in level over time due to the inherent decay times associated with filters and associated circuitry. Thus, the filtering process involved in decorrelation often results in a degraded transient response, or transient 'crispness'.

To overcome such undesirable effects, decorrelation circuits often have a level adjustment stage following the filter structures to attenuate these artifacts, or other similar post-decorrelation processing. Thus, present decorrelation circuits are limited in that they attempt to correct temporal smearing and other degradation effects after the decorrelation filters, rather than performing an appropriate amount of decorrelation based on the characteristics and components of the input signal itself. Such systems, therefore, do not adequately solve the issues associated with impulse or transient signal processing. Specific drawbacks associated with present decorrelation circuits include degraded transient response, susceptibility to downmix artifacts, and a limitation on the number of mutually-decorrelated outputs.

With respect to the issue of degraded transient response, the aim of current decorrelators is to decorrelate the complete input signal, irrespective of its contents or structure. Specifically, transient signals (e.g., the onset of percussive instruments) are in actual recordings usually not decorrelated, while their sustaining part, or the reverberant part present in a recording, is often decorrelated. Prior-art decorrelation circuits are generally not capable of reproducing this distinction, and hence their output can sound unnatural or may have a degraded transient response as a result.

With respect to the issue of downmix artifacts, the outputs of decorrelators are often not suitable for downmixing due to the fact that part of the decorrelation process involves delaying the input. Summing a signal with a delayed version thereof results in undesirable comb-filter artifacts due to the repetitive occurrence of peaks and notches in the summed frequency spectrum. As downmixing is a process that occurs frequently in audio coders, AV receivers, amplifiers, and alike, this property is problematic in many applications that rely on decorrelation circuits.

With respect to the issue of the limited number of mutually decorrelated outputs, in order to prevent audible echoes and undesirable temporal smearing artifacts, the total delay applied in a decorrelator is often fairly small, such as on the order of 10 to 30 ms. This means that the number of mutually independent outputs, if required, is limited. In practice, only two or three outputs can be constructed by delays that are mutually significantly decorrelated, and do not suffer from the aforementioned downmix artifacts.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments are directed to a method for processing an input audio signal by separating the input audio signal into a transient component characterized by fast fluctuations in the input signal envelope and a continuous component characterized by slow fluctuations in the input signal envelope, processing the continuous component in a decorrelation circuit to generate a decorrelated continuous signal, and combining the decorrelated continuous signal with the transient component to construct an output signal. In this embodiment, the fluctuations are measured with respect to time and the transient component is identified by a time-varying characteristic that exceeds a pre-defined threshold value distinguishing the transient component from the continuous component. The time-varying characteristic may be one of energy, loudness, and spectral coherence. The method under this embodiment may further comprise estimating the envelope of the input audio signal, and analyzing the envelope of the input audio signal for changes in the time-varying characteristic relative to the pre-defined threshold value to identify the transient component. This method may also comprise pre-filtering the input audio signal to enhance or attenuate certain frequency bands of interest, and/or estimating at least one sub-band envelope of the input audio signal to detect one or more transients in the at least one sub-band envelope and combining the sub-band envelope signals together to generate wide- band continuous and wide-band transient signals.

In an embodiment, the method further comprises applying weighting values to at least one of the transient component, the continuous component, the input signal, and the decorrelated continuous signal, wherein the weighting values comprise mixing gains. The decorrelated continuous signal may be scaled with a time-varying scaling function, dependent on the envelope of the input audio signal and the output of the decorrelation circuit. The decorrelation circuit may comprise a plurality of all-pass delay sections, and the envelope of the decorrelated continuous signal may be predicted from the envelope of the continuous component. The method may further comprise filtering the continuous component and/or the decorrelated continuous signal to obtain a frequency-dependent correlation in the output signals.

In an embodiment, the input audio signal may be an object-based audio signal having spatial reproduction data, and in wherein the weighting values depend on the spatial reproduction data; and the spatial reproduction data may comprise at least one: object width, object size, object correlation, and object diffuseness.

Some further embodiments are described for systems or devices and computer-readable media that implement the embodiments for the method of processing an input audio signal described above.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Systems and methods are described for a transient processor that processes an input audio signal before the application of decorrelation filtering. The transient processor analyzes the characteristics and content of the input signal and separates the transient components from the stationary or continuous components of the input signal. The transient processor extracts the transient or impulse components of the input signal and transmits the continuous signal to a decorrelator circuit, where the continuous signal is then decorrelated according to the defined decorrelation function, while the transient component of the input signal remains not decorrelated. An output stage combines the decorrelated continuous signal with the extracted transient component to form an output signal. In this manner, the input signal is appropriately analyzed and deconstructed prior to any decorrelation filtering so that proper decorrelation can be applied to the appropriate components of the input signal, and distortion due to decorrelation of transient signals can be prevented.

Aspects of the one or more embodiments described herein may be implemented in an audio or audio-visual (AV) system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Figure 1:
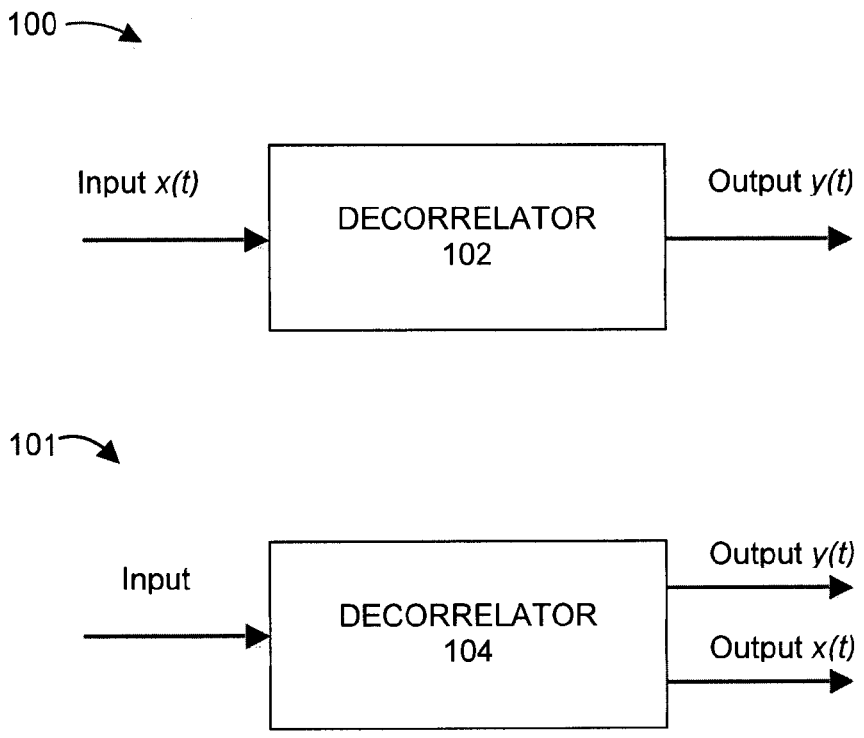
FIG. 1 (PRIOR ART)
FIG. 1 illustrates example configurations of decorrelation circuits as known in the prior art.
Figure 2:
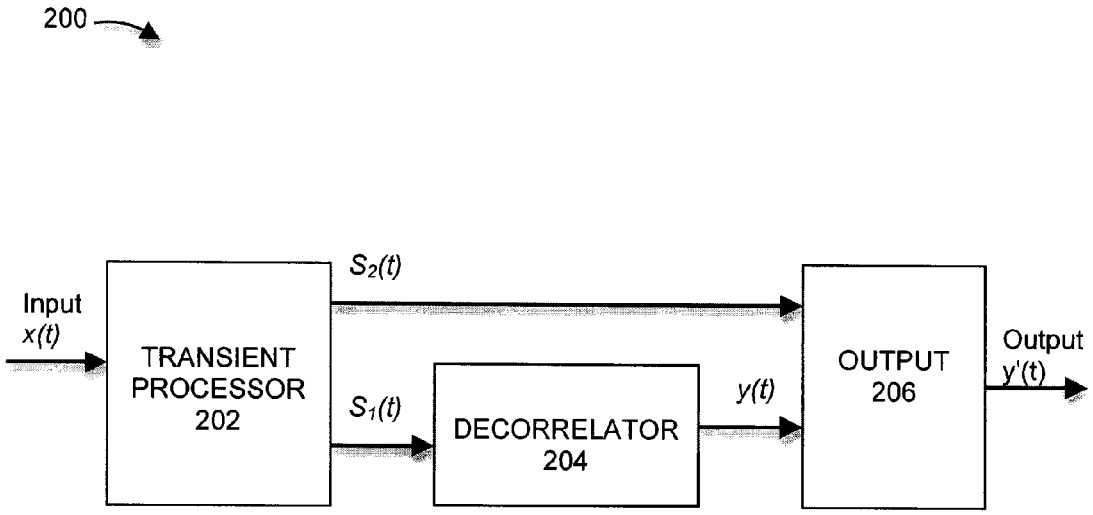
FIG. 2 is a block diagram illustrating a transient-processing based decorrelator circuit, under an embodiment.

FIG. 2 is a block diagram illustrating a transient-processor based decorrelator circuit, under an embodiment. As shown in circuit 200, an input signal x(t) is input to a transient processor 202. The input signal x(t) is analyzed by the transient processor, which identifies transient components of the signal versus the continuous components of the signal. The transient processor 202 extracts the transient or impulse component of input x(t) to generate an intermediate signal $s_1(t)$ and a transient content (auxiliary) signal $s_2(t)$. The intermediate signal $s_1(t)$ comprises the continuous signal content, which is then processed by a decorrelator 204 to produce output y(t). The transient content signal $s_2(t)$ is passed straight through to output stage 206 without any decorrelation applied, so that no temporal smearing or other distortion due to impulse decorrelation is produced. The output stage 206 combines the transient component $s_2(t)$ and the decorrelator output y(t) to produce output y'(t). The output y'(t) thus comprises a combination of the decorrelated continuous signal component and the non-decorrelated transient component. Circuit 200 processes the input signal by a transient processor before applying any decorrelation filters, in contrast with current decorrelator circuits that correctively process the signal after decorrelation.

As shown in FIG. 2, the transient component $s_2(t)$ of the signal is separated from the continuous component $s_1(t)$ and sent straight to the output stage without any decorrelation performed. Alternatively, the transient component $s_2(t)$ may also be decorrelated by a separate decorrelation circuit that applies less decorrelation or applies a different decorrelation process than the continuous signal decorrelator.

Transient Processor

As shown in FIG. 2, an input signal x(t) is processed by a transient processor 202 resulting in intermediate signal $s_1(t)$ and an auxiliary signal $s_2(t)$, of which only the $s_1(t)$ is processed by a decorrelator 204 to result in decorrelated output y(t). The signal $s_1(t)$ is associated with or comprised of the continuous segments of the input signal x(t), while the extracted signal $s_2(t)$ represents the signal segments or components of x(t) associated with fast or large fluctuations in signal level, i.e., the transient components of the signal. A transient signal is generally defined as a signal that changes signal level in a very short period of time, and may be characterized by a significant change in amplitude, energy, loudness, or other relevant characteristic. One or more of these characteristics may be defined by the system to detect the presence of transient components in the input signal, such as certain time (e.g., in milliseconds) and/or level (e.g., in dB) values.

In an embodiment, the transient processor 202 of FIG. 2 can comprise a transient detector that responds to any sudden increases or decreases in the input signal level. Alternatively, it may be embodied in a segmentation algorithm that identifies signal segments that contain one or more transients, or a transient extractor that separates a transient signal from continuous signal segments, or any similar transient processing method.

In an embodiment, the transient process includes an envelope estimation function that estimates an envelope $e_1(t)$ of the input signal x(t): $e_1(t)=F(x(t))$, where F(.) is an envelope estimation function. Such a function can comprise a Hilbert transform, a peak detection, or a short-term RMS estimation according to the following formula:

$$f(x(t))=\sqrt{\int_{\tau=0}^{\infty} x^2(t-\tau)w(\tau)}$$

In the above equation, w(t) is a window function. A common window function comprises an exponential decay as follows:

$$f(x(t))=\sqrt{\int_{\tau=0}^{\infty} x^2(t-\tau)\epsilon(\tau)\exp(-c\tau)}$$

In the above equation, $\epsilon(t)$ is the step function, and c is a coefficient that determines the effective duration or decay from which to calculate the energy or RMS value. An alternative and possibly more efficient consuming envelope extractor may be given by:

$$f(x(t))=\int_{\tau=0}^{\infty} |x(t-\tau)|\epsilon(\tau)\exp(-c\tau)$$

In some embodiments, the signal x(t) is filtered prior to calculating the envelope to enhance or attenuate certain frequency regions of interest, for example by using a high-pass filter.

In one embodiment, two or more envelopes are calculated using different integration durations reflected by differences in the decay coefficient $c_i$:

$$e_i(t)=f_i(x(t))=\sqrt{\int_{\tau=0}^{\infty} x^2(t-\tau)\epsilon(\tau)\exp(-c_i\tau)}$$

In yet another embodiment, a leaky peak-hold algorithm is used to compute an envelope:

$$e(t)=f(x(t))=\max(x(t-\tau)\epsilon(\tau)\exp(-c\tau))$$

In yet another embodiment, the envelope is computed from the absolute value of the signal (e.g. the amplitude):

$$e(t)=\mathrm{abs}(x(t))$$

For transient processing, the envelope e(t) is analyzed for sudden changes which indicate strong changes in the energy level in the input signal x(t). For example, if e(t) increases by a certain, pre-defined amount (either in absolute terms, or relative to its previous value or values), the signal associated with that increase may be designated as a transient. In an embodiment, a change of 6 dB or greater may trigger the identification of a signal as a transient. Other values may be used depending on the requirements and constraints of the system and application, however.

Alternatively, in an embodiment, a soft decision function utilized in the transient processor 202 may be applied that rates the probability of a signal containing a transient. A suitable function is the ratio of two envelope estimates $e_1(t)$ and $e_2(t)$ calculated with different integration times, for example 5 and 100 ms, respectively. In such case, the signal x(t) can be decomposed into signal $s_1(t)$ and $s_2(t)$:

$$s_1(f,t)=x(f,t)\min\left(1,\frac{e_2(f,t)}{e_1(f,t)}\right)$$

$$s_2(f,t)=x(f,t)-s_1(f,t)$$

This is equivalent to:

$$s_2(t)=x(t)\left(1-\min\left(1,\frac{e_2(t)}{e_1(t)}\right)\right)$$

In this embodiment, the signals $s_1(t)$ and $s_2(t)$ can be formulated as a product of the input signal x(t) with a time-varying gain function a(t) dependent on the envelope of x(t):

$$s_1(t)=x(t)\ a_1(t)$$

$$s_2(t)=x(t)\ a_2(t)$$

with $$a_1(t)=\min\left(1,\frac{e_2(t)}{e_1(t)}\right)$$

-continued $$a_2(t) = 1 - \min\left(1, \frac{e_2(t)}{e_1(t)}\right)$$

In the case of sudden increases in the signal x(t), envelope $e_1(t)$ will react faster upon the change in x(t) than envelope $e_2(t)$, and hence the transient will be attenuated by the quotient of $e_2(t)$ and $e_1(t)$ Consequently, the transient is not, or only partially included in $s_1(t)$.

In another embodiment, the signal $s_2(t)$ may comprise signal segments that were classified as 'transient', while the signal $s_1(t)$ may comprise all other segments. Such segmentation of audio signals into transient and continuous signal frames is part of many lossy audio compression algorithms.

In an alternative embodiment, the transient processor 202 may perform subband transient processing as opposed to envelope processing. The above-described method utilizes a wide-band envelope e(t). In this alternative embodiment, a sub-band envelope e(f,t) can be estimated as well in order to detect transients in each subband, where f stands for a sub-band index. Since an audio signal is generally a mixture of different sources, detecting transients in subbands may have benefit to detect the transients or onsets of each source. It may also potentially enhance the subband-based decorrelation technologies.

Subband transients can be estimated in a similar way as described above, for example, as shown in the following equations:

$$s_1(f,t)=x(f,t)\min(1, e_2(f,t)/e_1(f,t))$$

$$s_2(f,t)=x(f,t)-s_1(f,t)$$

In the above equations, x(f,t) is the subband audio signal, $s_2(f,t)$ comprises the subband 'transient' signal, and $s_1(f,t)$ comprises the subband 'stationary' signal.

Combining all the subband signals together, the wide-band 'stationary' $s_1(t)$ and 'transient' signal $s_2(t)$ can be obtained, as follows:

$$s_1(t)=\Sigma_f s_1(f, t)$$

$$s_2(t)=\Sigma_f s_2(f, t)$$

In certain cases, transients can be detected from spectral coherence. Thus, in an alternative embodiment, the transient processor 202 may perform spectral coherence-based transient processing. For this embodiment, the transient processor 202 includes a comparator that compares an energy envelope e(t) that detects the abrupt energy change of the audio signal. This embodiment uses the fact that spectral coherence is able to detect spectral changes to detect where new audio events or sources appear.

The spectral coherence c(t) of an audio signal at time t, in one embodiment, can be simply measured by the spectral similarity between two contingent frames/windows before and after time t, for example by the following equation:

$$c(t) = \frac{\Sigma_f X_l(f, t)X_r(f, t)}{\sqrt{\Sigma_f X_l^2(f, t)\Sigma_f X_r^2(f, t)}}$$

In the above equation, $X_l(f,t)$ and $X_r(f,t)$ are the spectra of the left and right frame/window at time t. The spectral coherence c(t) can be further smoothed (for example, by running average) in a long window to get a long-term coherence. In general, a small coherence may indicate a spectral change. For example, if c(t) decreases by a certain, pre-defined amount (either in absolute terms, or relative to its previous value or values), the signal associated with that decrease may be designated as transient.

Alternatively, a soft decision function similar to that described above may be also applied. Two coherence estimates $c_1(t)$ and $c_2(t)$ can be calculated or smoothed with different window sizes, in which coherence $c_1(t)$ will react faster upon the change in x(t) than coherence $c_2(t)$. Similarly, the signal x(t) can be decomposed into signal $s_1(t)$ and $s_2(t)$ as follows:

$$s_1(t) = x(t)\min\left(1, \frac{c_1(t)}{c_2(t)}\right)$$

$$s_2(t) = x(t) - s_1(t)$$

It should be noted that in the above formula, the quotient of $c_1(t)$ and $c_2(t)$ is used to attenuate the transient, rather than dividing $c_2(t)$ by $c_1(t)$.

While the above-presented coherence is computed from the wide-band spectrum, it should be noted that the subband method as described above can also be applied in this case.

Transient processing can also be performed in the loudness domain. This embodiment takes advantage of the fact that sudden changes in the loudness of a signal can indicate the presence of transient components in a signal. The transient processor can thus be configured to detect changes in loudness of the input signal x(t). In this embodiment, the above- described embodiments can be extended to include a function that processes the signal in the loudness domain, where the loudness, rather than the energy or amplitude, is applied. For this embodiment, and in general, loudness is a nonlinear transform of energy or amplitude.

Decorrelation

As shown in FIG. 2, circuit 200 includes a decorrelator 204 that decorrelates the continuous signal $s_2(t)$. In an embodiment, the decorrelator 204 is implemented as a filter operation convolving a signal $s_1(t)$ with a decorrelation filter impulse response d(t), as shown in the following equation:

$$y(t)=\int_{\tau=0}^{\infty} s_1(t-\tau)d(\tau)d\tau$$

Figure 3:
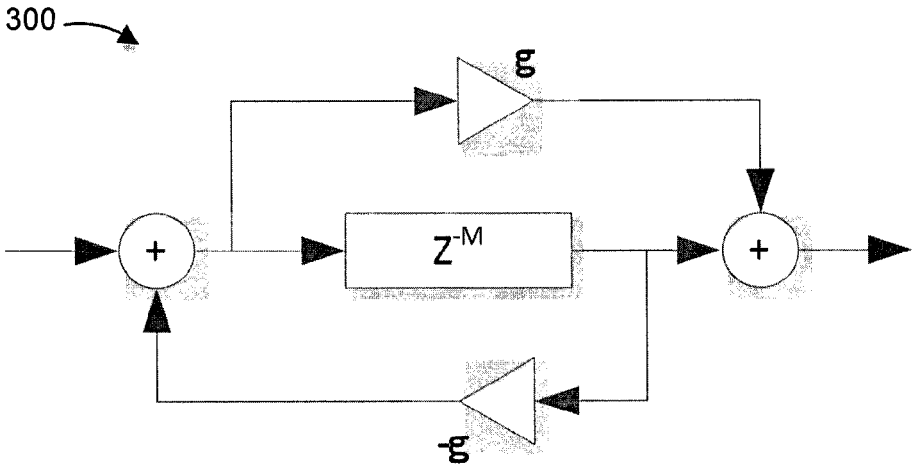
FIG. 3 illustrates a decorrelator circuit for use in a transient-processing based decorrelation system, under an embodiment.

In one embodiment, the decorrelator includes a decorrelation filter that comprises a number of cascaded all-pass delay sections. FIG. 3 illustrates a digital filter representation of an all-pass delay section that can be used in a decorrelator in a transient processor based decorrelation system, under an embodiment. As shown in FIG. 3, filter circuit 300 consists of a delay of M samples, and a coefficient g that is applied to a feedforward and feedback path. Several sections of filter 300 may be combined to construct a pseudo-random impulse response with a flat magnitude spectrum resulting from the cascaded circuit. The number of sections can vary depending on the implementation and the requirements and constraints of the particular signal processing application. A benefit of using cascaded all-pass delay sections as shown in FIG. 3 is that multiple decorrelators can be constructed fairly easily that produce mutually uncorrelated output that can be mixed without creating comb-filter artifacts, by randomizing their delays and/or coefficients.

Although FIG. 3 illustrates a specific type of filter circuit that may be used for decorrelator circuit 200, and other types or variations of decorrelator circuits may also be used.

In certain embodiments, one or more components may be provided to perform certain decorrelator post-processing functions. For example, in certain practical cases, it may be useful to apply a post-decorrelator attenuation function to remove or attenuate the decorrelator output signal if the envelope of the input signal suddenly decreases. In an embodiment, the transient-processor based decorrelation system includes one or more advanced temporal envelope shaping tools that estimate the temporal envelope of the input signal of the decorrelator, and subsequently modify the output signal of the decorrelator to closely match the envelope of its input. This helps alleviate the problem associated with post-echo artifacts or ringing caused by decorrelation filtering the abrupt end of transient signals.

In the case of a cascade of all-pass delay sections, the envelope of the output of each all-pass delay section $e_{ap,out}[n]$ can be predicted from the envelope of its input $e_{ap,in}[n]$ by the following equation:

$$e_{ap,out}[n]=e_{ap,out}[n]c+(1-c)e_{ap,in}[n]$$

In the above equation, the coefficient c relates to the delay M and coefficient g of the all-pass delay section as follows: $c=g^{1/M}$. This formulation allows an estimation of the envelope of a cascade of all-pass delay sections by cascading the above output envelope approximation functions. The decorrelator output signal is subsequently multiplied by the quotient of the input and output envelope of the all-pass delay cascade as shown in the following equation:

$$y'[n] = y[n]\min\left(1, \frac{e_{ap,in}[n]}{e_{ap,out}[n]}\right)$$

Figure 4:
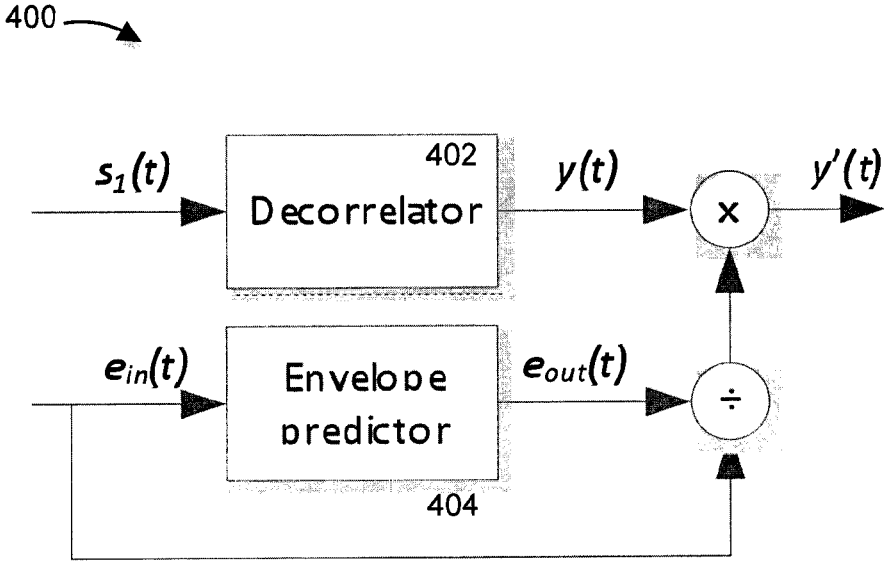
FIG. 4 is a block diagram that illustrates a decorrelator post-processing circuit that performs output envelope prediction and output level adjustment, under an embodiment.

FIG. 4 is a block diagram that illustrates a decorrelator post-processing circuit that performs output envelope prediction and output level adjustment, under an embodiment. As shown in FIG. 4, circuit 400 includes a decorrelator 402 that accepts an input signal $s_1(t)$ and an envelope prediction component 404 that accepts envelope input $e_{in}(t)$. The respective outputs y(t) and $e_{out}(t)$ are then combined as shown to produce output y'(t).

The envelope predictor 404 estimates the envelope of y(t) given an input envelope of $e_{in}(t)$, which is generated by the transient processor 202 from the input signal x(t). The envelope input $e_{in}(t)$ is the envelope of the $s_1(t)$ signal, and is a combination of the $e_1(t)$ and $e_2(t)$ envelope estimates, as provided by the equation given above:

$$s_1(t)=x(t)\min(1, (e_1(t)/e_2(t)).$$

Output Signal Construction

Figure 5:
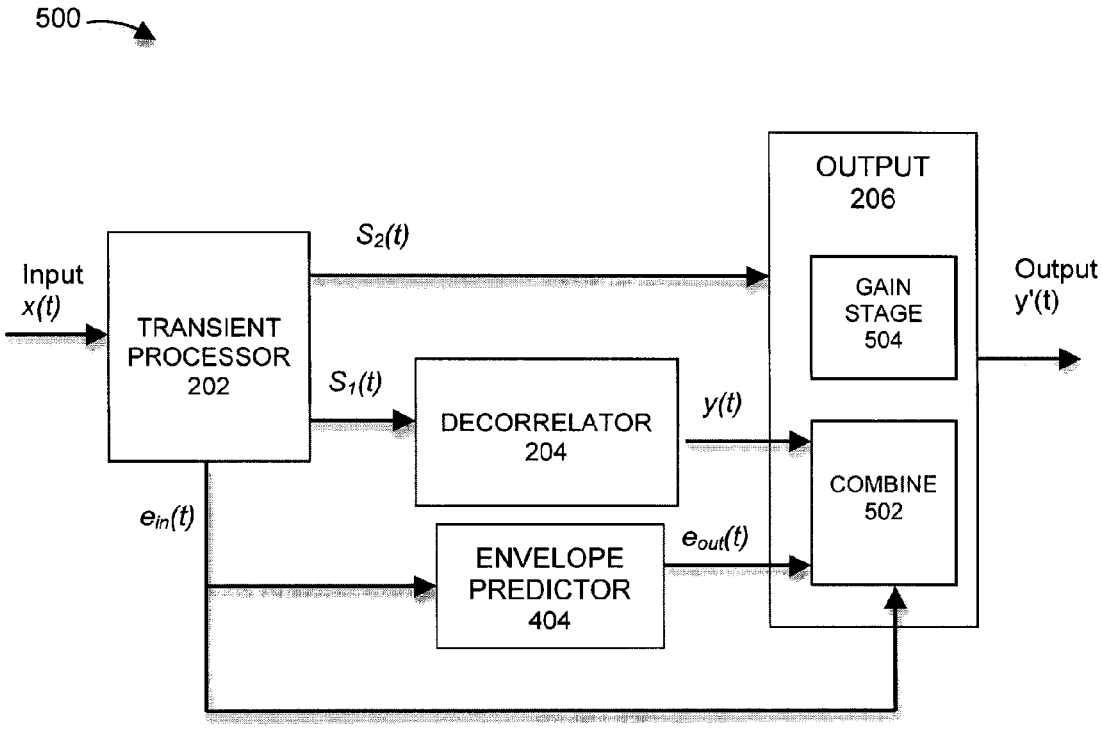
FIG. 5 illustrates a decorrelation system including an envelope predictor circuit, under an embodiment.

In an embodiment, the decorrelation system includes an output circuit 206 that processes the output of the decorrelator along with the transient component of the input signal generated by the transient processor to form the output signal y'(t). Such an output circuit can also be used in conjunction with the envelope predictor circuit 400. FIG. 5 illustrates the decorrelation system 200 of FIG. 2 as modified to include the envelope predictor circuit, under an embodiment. As shown in circuit 500 of FIG. 5, the envelope predictor component 404 is combined with the decorrelator circuit 204 and output component 206 includes a combinatorial circuit that processes the envelope $e_{in}(t)$, $e_{out}(t)$ and decorrelator output signals y(t) in accordance with circuit 400 of FIG. 4. The output stage also processes the transient signal component $s_1(t)$ to generate output y'(t).

In an embodiment, the output component 206 processes the signals x(t), $s_1(t)$, $s_2(t)$ and y'(t) to construct two or more signals with a variable correlation, or perceived spatial width. For example, a stereo pair l(t), r(t) of output signals may be constructed using:

$$l(t)=x(t)+s_2(t)+y'(t)$$

$$r(t)=x(t)+s_2(t)-y'(t)$$

The auxiliary signal $s_2(t)$ ensures compensation for signal segments of input signal x(t) that were excluded from the decorrelator input $s_1(t)$. In other embodiments, multiple decorrelator signals $y_q'(t)$ may be used to construct a set of output signals $z_r(t)$ as follows:

$$z_r(t)=P_{r,q,1}x(t)+P_{r,q,2}s_2(t)+P_{r,q,3}y_q'(t)$$

In the above equation, the $P_{r,q,x}$ values represent output mixing gains or weights. As shown in FIG. 5, the output component 206 includes a gain stage 504 that applies the appropriate gain or weight values. In an embodiment, the gain stage 504 is implemented as a filter bank circuit that applies output mixing gains to obtain a frequency-dependent correlation in the output signals. For example, simple, complementary shelving filters may be applied to x(t), $s_2(t)$ and/or $y_q'(t)$ to create a frequency-dependent contribution of each signal to the output signal $z_r(t)$.

The gain stage 504 may be configured to compensate for particular characteristics associated with specific implementations of the signal processing system. For example, in the case where the relative contribution of x(t) compared to $y_q'(t)$ may be larger at very low frequencies (e.g., below approximately 500 Hz), the circuit may be configured to simulate the effect that in real-life environments, the correlation of the signals arriving at the ear drums as a result of an acoustic diffuse field will result in a higher correlation at low frequencies than at high frequencies. In another example case, the relative contribution of x(t) compared to $y_q'(t)$ may be smaller at frequencies above approximately 2 kHz because humans are generally less sensitive to changes in correlation above 2 kHz than at lower frequencies. The circuit can thus be configured accordingly to compensate for this effect as well.

In some embodiments, $s_2(t)$ may be a scaled version of x(t) using scale function $a_2(t)$ and hence the following formulation is then equivalent to the one above:

$$z_r(t)=x(t)(P_{r,q,1}+P_{r,q,2}a_2(t))+P_{r,q,3}y_q'(t)$$

or $$z_r(t)=x(t)Q_x(t)+y_q'(t)Q_q(t)$$

This means that the output signal $z_r(t)$ can be formulated as a linear combination of the input signal x(t) and the decorrelator output $y_q'(t)$, in which the weights $Q_x(t)$ are dependent on the envelope of x(t).

Application to Object-Based Audio

In an embodiment, the transient-based decorrelation system may be used in conjunction with an object-based audio processing system. Object-based audio refers to an audio authoring, transmission and reproduction approach that uses audio objects comprising an audio signal and associated spatial reproduction information. This spatial information may include the desired object position in space, as well as the object size or perceived width. The object size or width can be represented by a scalar parameter (for example ranging from 0 to +1, to indicate minimum and maximum object size), or inversely, by specifying the inter-channel cross correlation (ranging from 0 for maximum size, to +1 for minimum size). Additionally, any combination of correlation and object size may also be included in the metadata. For example, the object size can control the energetic distribution of signals across the output signals, e.g., the level of each loudspeaker to reproduce a certain object; and object correlation may control the cross-correlation between one or more output pairs and hence influence the perceived spatial diffuseness. In this case, the size of the object may be specified as a metadata definition, and this size information is used to calculate the distribution of the sound across an array of signals. The decorrelation system in this case provides spatial diffuseness of the continuous signal components of this object and limits or prevents decorrelation of the transient components.

In general, a loudspeaker signal $z_r(t)$ for loudspeaker index r would be constructed by a linear combination of the input signal x(t), the auxiliary signal $s_2(t)$, and the output of one or more decorrelation circuits $y_q'(t)$ as follows:

$$z_r(t)=P_{r,q,1}x(t)+P_{r,q,2}s_2(t)+P_{r,q,3}y_q'(t)$$

In the case of a stationary input signal, $s_2(t)$ will be small or even zero. In that case, the correlation p between signal pairs $z_1$, $z_2$ can be set according to:

$$z_1(t)=\cos(\alpha+\beta)x(t)+\sin(\alpha+\beta)y_1(t)$$

$$z_2(t)=\cos(\alpha-\beta)x(t)+\sin(\alpha-\beta)y_1(t)$$

In the above equations, α is a free-to-choose angle, and β depends on the desired correlation ρ, and is given by: $\beta=0.5\arccos(\rho)$.

Alternatively, the following formulation may be used:

$$z_1(t)=\sqrt{\frac{1+\rho}{2}}\,x(t)+\sqrt{\frac{1-\rho}{2}}\,y_1(t)$$

$$z_2(t)=\sqrt{\frac{1+\rho}{2}}\,x(t)-\sqrt{\frac{1-\rho}{2}}\,y_1(t)$$

When the signal $s_2(t)$ is nonzero, the following equations can be applied:

$$z_1(t)=\sqrt{\frac{1+\rho}{2}}\,(x(t)+s_2(t))+\sqrt{\frac{1-\rho}{2}}\,y_1(t)$$

$$z_2(t)=\sqrt{\frac{1+\rho}{2}}\,(x(t)+s_2(t))-\sqrt{\frac{1-\rho}{2}}\,y_1(t)$$

In the above equations, the signals $z_1$, $z_2$ may subsequently be subject to scaling to adhere to a certain level distribution depending on the desired object size. For this embodiment, the output y(t) of the decorrelation circuit 204 is scaled with a time-varying scaling function, dependent on the envelope of the input signal x(t) and the output of the decorrelation circuit.

Figure 6:
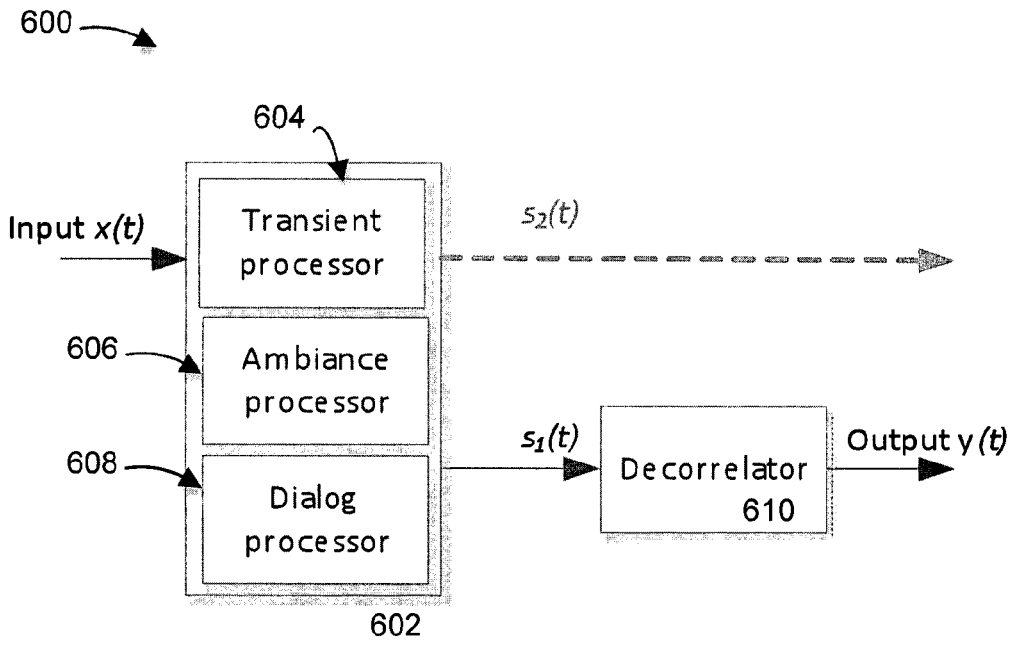
FIG. 6 illustrates certain pre-processing functions for use with a transient-based decorrelation system, under an embodiment.

In an embodiment, the transient-based decorrelation system may include one or more functional processes that are applied before the decorrelation filters which modify the input to the decorator circuit. FIG. 6 illustrates certain pre-processing functions for use with a transient-based decorrelation system, under an embodiment. As shown in FIG. 6, circuit 600 includes a pre-processing stage 602 that includes one or more pre-processors. For the example shown, the pre-processing stage 602 includes an ambiance processor 606 and a dialog processor 602 along with the transient processor 604. These processors can be applied individually or jointly before the decorrelator.

They may be provided as functional components within the same processing block, as shown in FIG. 6, or they may be provided as individual components that perform functions prior or subsequent to transient processor 604.

In an embodiment, the ambiance processor 606 extracts or estimates ambiance signal $s_1(t)$ from direct signals $s_2(t)$, and only the ambiance signal is processed by the decorrelator 610, since ambiance is usually the most important component in enhancing immersive or envelopment experience.

The dialog processor 608 extracts or estimates dialog signal $s_2(t)$ from other signals $s_1(t)$, and only the other (non-dialog) signals are processed by the decorrelator 610, since decorrelation algorithms may negatively influence dialog intelligibility. Similarly, the ambiance processor 604 may separate the input signal x(t) into a direct and ambiance component. The ambiance signal may be subjected to the decorrelation, while the dry or direct components may be sent to $s_2(t)$ Other similar pre-processing functions may be provided to accommodate different types of signals or different components within signals to selectively apply decorrelation to the appropriate signal components. For example, a content analysis block (not shown) may also be provided that analyzes the input signal x(t) and extracts certain defined content types to apply an appropriate amount of decorrelation to minimize any distortion associated with the filtering processes.

Figure 7:
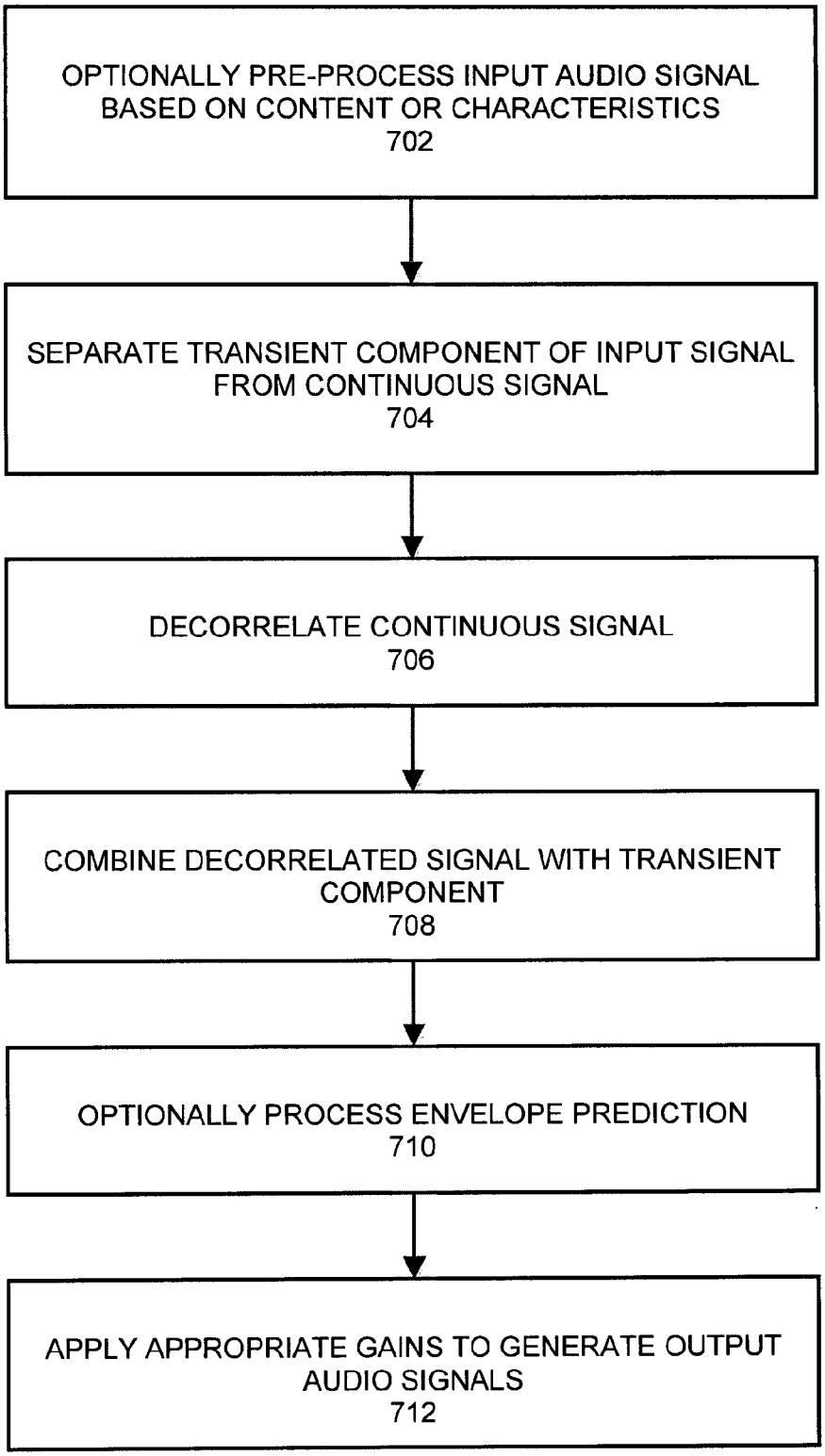
FIG. 7 illustrates a method of processing an audio signal in a transient-processing based decorrelator system, under an embodiment.

FIG. 7 illustrates a method of processing an audio signal in a transient-processing based decorrelation system, under an embodiment. The process of FIG. 7 separates the transient (fast varying) component of an input signal from the continuous (slow varying) or stationary component of an input signal (704). The continuous signal component is then decorrelated (706). Prior to the separation step and as shown in block 702, the process may optionally pre-process the input signal based on content or characteristics (e.g., ambience, dialog, etc) in order to transmit the appropriate signal components to the decorrelator in block 706 so that components of the signal other than those based purely on transient/continuous characteristics are decorrelated or not decorrelated accordingly. As shown in block 708, the decorrelated signal is combined with the transient component to form an output signal (708), to which appropriate gain or scaling factors may be applied to form a final output (712). The process may also apply an optional envelope prediction step 710 as a decorrelator post-processing step to attenuate the decorrelator output to minimize post-echo distortion. In an embodiment, the input signal processed by the method of FIG. 7 may comprise an object-based audio system that includes spatial queues that are encoded as metadata associated with the audio signal.

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method for processing an input audio signal, comprising:

separating the input audio signal into a transient component characterized by fast fluctuations in the input signal envelope and a continuous component characterized by slow fluctuations in the input signal envelope;

processing the continuous component in a decorrelation circuit to generate a decorrelated continuous signal, wherein the decorrelated continuous signal is scaled with a time-varying scaling function, dependent on the envelope of the input audio signal and the output of the decorrelation circuit; and combining the decorrelated continuous signal with the transient component to construct an output signal.

2. The method of claim 1, wherein the fluctuations are measured with respect to time and the transient component is identified by a time-varying characteristic that exceeds a pre-defined threshold value distinguishing the transient component from the continuous component.

3. The method of claim 2 wherein the time-varying characteristic is selected from the group consisting of amplitude, energy, loudness, and spectral coherence.

4. The method of claim 3 further comprising:

estimating the envelope of the input audio signal; and analyzing the envelope of the input audio signal for changes in the time-varying characteristic relative to the pre-defined threshold value to identify the transient component.

5. The method of claim 2 further comprising performing at least one of: pre-filtering the input audio signal to enhance or attenuate certain frequency bands of interest, and estimating at least one sub-band envelope of the envelope of the input audio signal to detect one or more transients in the at least one sub-band envelope and combining the sub-band envelope signals together to generate wide-band continuous and wide-band transient signals.

6. The method of claim 1 further comprising applying weighting values to at least one of the transient component, the continuous component, the input signal, and the decorrelated continuous signal, wherein the weighting values comprise mixing gains.

7. The method of claim 1 wherein the decorrelation circuit comprises a plurality of all-pass delay sections.

8. The method of claim 6 wherein an envelope of the decorrelated continuous signal is predicted from an envelope of the continuous component.

9. The method of claim 1 further comprising filtering at least one of the continuous component and the decorrelated continuous signal to obtain a frequency-dependent correlation in the output signals.

10. The method of claim 6 wherein the input audio signal comprises an object-based audio signal having spatial reproduction data, and in wherein the weighting values depend on the spatial reproduction data.

11. The method of claim 10 wherein the spatial reproduction data comprises at least one of: object width, object size, object correlation, and object diffuseness.

12. An apparatus for processing an input audio signal, comprising:

a transient processor separating the input audio signal into a transient component characterized by fast fluctuations in the input signal envelope and a continuous component characterized by slow fluctuations in the input signal envelope;

a decorrelation circuit coupled to the transient processor and decorrelating the continuous component to generate a decorrelated continuous signal;

an output stage coupled to the decorrelation circuit and transient processor combining the decorrelated continuous signal transient component to construct an output signal; and a gain circuit associated with the output stage and configured to apply weighting values to at least one of the transient component, the continuous component, the input signal, and the decorrelated continuous signal, wherein the weighting values comprise mixing gains, and further wherein the decorrelated continuous signal is scaled with a time-varying scaling function, dependent on the envelope of the input audio signal and the output of the decorrelation circuit.

13. The apparatus of claim 12, wherein the fluctuations are measured with respect to time and the transient component is identified by a time-varying characteristic that exceeds a pre-defined threshold value distinguishing the transient component from the continuous component, and wherein the time-varying characteristic is selected from the group consisting of amplitude, energy, loudness, and spectral coherence.

14. The apparatus of claim 13 further comprising an envelope processor coupled to the transient processor and configure to estimate the envelope of the input audio signal, and analyze the envelope of the input audio signal for changes in the time-varying characteristic relative to the pre-defined threshold value to identify the transient component.

15. The apparatus of claim 14 further comprising:

a pre-filter stage pre-filtering the input audio signal to enhance or attenuate certain frequency bands of interest; and a sub-band processor estimating at least one sub-band envelope of the envelope of the input audio signal to detect one or more transients in the at least one sub-band envelope and combining the sub-band envelope signals together to generate wide-band continuous and wide-band transient signals.

16. The apparatus of claim 12 wherein the decorrelation circuit comprises a plurality of all-pass delay sections.

17. The apparatus of claim 12 further comprising an envelope predictor coupled to the transient processor, and configured to predict an envelope of the decorrelated continuous signal from an envelope of the continuous component.

18. The apparatus of claim 12 further comprising a filter stage filtering at least one of the continuous component and the decorrelated continuous signal to obtain a frequency-dependent correlation in the output signals.

19. The apparatus of claim 12 wherein the input audio signal comprises an object-based audio signal having spatial reproduction data, and in wherein the weighting values depend on the spatial reproduction data, and wherein the spatial reproduction data comprises at least one: object width, object size, object correlation, and object diffuseness.

20. A method for processing an input signal, comprising:

analyzing a signal envelope of the input signal to identify a continuous component of the input signal from a transient component of the input signal;

decorrelating the continuous component to generate a decorrelated continuous signal passing the transient component to an output stage;

combining the transient component and the decorrelated continuous signal in the output stage to generate an output signal;

generating two envelope estimates calculated with different integration times of the input signal; and using a ratio of the two envelope estimates to distinguish the transient component from the continuous component.

21. The method of claim 20 further comprising estimating an envelope of the input signal using one of a Hilbert transform, a peak detection process, or a short-term RMS process.

22. The method of claim 20 the fluctuations are measured with respect to time and the transient component is identified by a time-varying characteristic that exceeds a pre-defined threshold value distinguishing the transient component from the continuous component, and further wherein the transient component characterized by fast fluctuations in the input signal envelope and a continuous component characterized by slow fluctuations in the input signal envelope.

23. The method of claim 22 wherein the time-varying characteristic is selected from the group consisting of amplitude, energy, loudness, and spectral coherence.

24. The method of claim 22 further comprising applying weighting values to at least one of the transient component, the continuous component, the input signal, and the decorrelated continuous signal, wherein the weighting values comprise mixing gains to generate the output signal.

25. The method of claim 24 wherein the decorrelated continuous signal is scaled with a time-varying scaling function, dependent on the envelope of the input audio signal and the output of the decorrelation circuit.

* * * * *